US007735818B2

(12) United States Patent
Fournier et al.

(10) Patent No.: US 7,735,818 B2
(45) Date of Patent: Jun. 15, 2010

(54) DOCUMENT PROCESSING MACHINE

(75) Inventors: Patrick Fournier, Paris (FR); Francois Reby, Nogent sur Marne (FR)

(73) Assignee: Pitney Bowes S.A.S., Saint Denis la Plaine (FR)

( * ) Notice: Subject to any disclaimer, the term of this patent is extended or adjusted under 35 U.S.C. 154(b) by 0 days.

(21) Appl. No.: 12/326,435

(22) Filed: Dec. 2, 2008

(65) Prior Publication Data

US 2009/0140488 A1 Jun. 4, 2009

(30) Foreign Application Priority Data

Dec. 3, 2007 (FR) ..... 07 59507

(51) Int. Cl.
*B65H 5/00* (2006.01)

(52) U.S. Cl. ..... 271/2; 271/250; 271/165

(58) Field of Classification Search ..... 271/165, 271/2, 127, 250, 249, 251
See application file for complete search history.

(56) References Cited

U.S. PATENT DOCUMENTS

| | | | | |
|---|---|---|---|---|
| 3,977,668 | A * | 8/1976 | Bologna et al. | 271/126 |
| 4,930,764 | A * | 6/1990 | Holbrook et al. | 271/119 |
| 5,112,037 | A * | 5/1992 | Holbrook | 271/2 |
| 5,397,119 | A * | 3/1995 | Brewster et al. | 271/171 |
| 6,267,372 | B1 * | 7/2001 | Mylaeus et al. | 271/250 |
| 6,629,691 | B2 * | 10/2003 | Niiyama et al. | 271/2 |

* cited by examiner

*Primary Examiner*—Kaitlin S Joerger
(74) *Attorney, Agent, or Firm*—George M. Macdonald; Angelo N. Chaclas

(57) ABSTRACT

A document processing machine including a document feeder including a support intended to receive a stack of documents, and a unit for extracting documents from the stack of documents and transferring the extracted documents onto a horizontal support of a downstream processing unit, wherein the support of the document feeder is inclined relative to the horizontal is described.

19 Claims, 4 Drawing Sheets

DOCUMENT PROCESSING MACHINE

RELATED APPLICATIONS

The present application claims priority of French Patent Application No. 0759507, filed Dec. 3, 2007, that is hereby incorporated by reference in its entirety.

BACKGROUND OF THE INVENTION

The invention generally relates to machines for processing diverse documents. In document processing machines, such as mail processing machines, the documents are often stored in document feeders in the form of a stack of documents.

The documents are extracted one by one from the stack and transferred in the downstream direction to undergo specific processing. For example, a feeder can contain a stack of filled envelopes from which the bottom envelope is extracted and is then transferred to a station situated downstream of the machine for moistening the envelope and sealing it. The envelope sealed in this way is then transferred to a downstream franking station. There is represented in FIG. 1*a* a stack 10 of documents such as envelopes resting on a support 12. The support comprises a horizontal table 14 with apertures through which pass partially rollers 16, 18, 20 mounted to rotate about a horizontal axis 22. A vertical wall 24 connected to the table 14 locates the stacked documents and therefore keeps them stacked.

When the stacked documents are envelopes, the flap of each envelope is folded and these flaps are on the same side as the vertical wall 24, which increases the thickness of the envelope on the same side as the vertical wall 24 and causes the stack to lean as represented in FIG. 1*a*. As and when envelopes at the bottom of the stack 10 are extracted therefrom by the rollers 16, 18, 20 to be processed downstream of the feeder (in the background in the figures), the stack moves away from the wall 24 (FIGS. 1*b* and 1*c*).

This displacement of the stack is also caused by vibrations generated by the envelope extraction mechanism and, more generally, by the various operations that are carried out downstream. If a number of envelopes have been pulled out in succession, the stack 10 is greatly offset in a direction away from the wall 24 (FIG. 1*c*). It will be noted that the means for extracting an envelope offset in this way, which are situated in the background in FIG. 1*c* (not shown), can prove of lower performance. Some means can even, in some cases, be unable to extract the envelope offset in this way.

When the offset envelope has been extracted after all and reaches the next processing station downstream of the feeder, it is however not correctly located at the station (misalignment compared to the normal path of the envelopes). Manual intervention by an operator is then necessary to return the envelope to a correct position at the entry of the station in order for it to be processed correctly at this station. The operator must also reposition the stack 10 against the wall 24 of the feeder.

The problems described hereinabove are also encountered with other types of stacked documents such as sheets of paper. However, these problems are exacerbated with envelopes because of the folded flap that makes them thicker and causes tilting of the stack before any envelopes are extracted.

SUMMARY OF THE INVENTION

The disclosed illustrative embodiments of the present invention provide for remedying at least one of the drawbacks cited above by proposing for example, a document processing machine including a document feeder including a support intended to receive a stack of documents and a unit for extracting documents from the stack of documents and transferring the extracted documents onto a horizontal support of a downstream processing unit, wherein the support of the document feeder is inclined relative to the horizontal.

Inclining the support transversely relative to the longitudinal direction of displacement of the documents prevents successive lateral displacements of the stack as and when documents at the bottom of the stack are extracted. This therefore avoids the drawbacks that are linked to the misalignment of the stack relative to the extraction unit and to the downstream processing system. The unextracted documents therefore remain stacked at the same place on the support, which guarantees a certain effectiveness of the downstream processing. Moreover, by inclining the support in the direction opposite that in which the stack naturally leans, its inclination is compensated and this therefore ensures that envelopes placed on top will not fall off the stack.

Downstream of the support of the feeder, the document support and working surface returns to the horizontal in order to modify as little as possible existing processing machines. According to one feature, the angle of inclination of the support is between 5 and 20°, preferably between 10 and 15°. It will be noted, however, that the angle of inclination of the support depends on the height of the stack of documents.

According to one feature, the feeder includes a document guide disposed along the feeder support in the longitudinal direction of transfer of documents, the guide forming with the horizontal, in cross section, an angle substantially corresponding to the angle to the horizontal of a downstream document guide disposed in part at the extraction and transfer unit. The guide is generally vertical, for example, just like the downstream guide. As a general rule, the inclination of the guide depends on the inclination of the downstream guide.

According to one feature, the guide constitutes the lower part of a wall and is adjacent to the inclined support. Accordingly, by virtue of the inclination of the support, the documents that are on the point of being extracted rest against this guide and are guided by it when they are extracted.

According to one feature, the wall includes an upper part that is inclined outward relative to the lower part, i.e. away from the support. This additional inclination at the top is favorable to alignment of the documents from the stack during unstacking (extraction of documents from the bottom).

According to one feature, the guide of the wall and the downstream guide are substantially coplanar. This arrangement ensures that a document guided on the inclined support when it is extracted will not abut against the guide situated at the level of the extraction unit and downstream.

It will be noted that the angular orientation or inclination of the two guides, in a view in a transverse plane, can differ by a few degrees without this interfering with the displacement of the documents. Moreover, the guide adjacent to the support can even be slightly offset transversely relative to the downstream guide, being placed closer to the inclined support than the downstream guide in a view in a transverse plane.

According to one feature, the support of the document feeder comprises at least one supplementary support member for supporting documents. This supplementary support member is useful when the size (width) of the documents stacked on the support in cross section is too great relative to the area in which are situated the members for supporting documents having a more usual size.

According to one feature, said at least one supplementary support member is disposed along the support in the longitudinal document transfer direction, on the side opposite the document guide. Thus the documents are on one side abutted against the guide and on the other side bear on one or more supplementary support members. Said at least one support member also contributes to holding the stack in position. Said at least one supplementary support member ensures correct separation of documents or envelopes whose width is such that they rest on it.

According to one feature, the support of the document feeder comprises a first series of drive and support members arranged in such a manner that the contact surface of the members with a document is in a plane inclined relative to the horizontal.

According to one feature, the drive members of the first series are adapted to be driven in rotation about an axis inclined relative to the horizontal, directed in the downstream direction and forming an angle less than 90° with the longitudinal document transfer direction. This arrangement of the rotation axes facilitates bringing documents up against the guide when they are extracted from the stack.

According to one feature, the first series of drive members includes several rows of members mounted to rotate about parallel axes.

According to one feature, said at least one supplementary support member of the support of the document feeder is disposed outside the area in which the first series of drive members is installed in order to support documents having, in cross section, dimensions greater than those of the area covered by the first series of drive members. The drive members of the first series cover in cross section an area corresponding to a more standard document format (document width) and the supplementary support member or members enlarge the supporting area of the support to adapt to supporting documents with greater dimensions.

It will be noted that the size of said at least one support member in a direction perpendicular to the plane of the inclined support (also referred to as its height) is substantially equal to that of the support drive members. A support member in the form of a longitudinal rib is used, for example.

According to one feature, the support of the document feeder comprises a plate inclined relative to the horizontal, with apertures through which the support drive members project relative to the upper surface of the plate.

According to one feature, said at least one supplementary support member is disposed on the top surface of the plate.

According to one feature, the unit for extracting and transferring documents includes a second series of drive members adapted to be driven in rotation about a transverse axis perpendicular to the longitudinal document transfer direction, the drive members being arranged in such a manner that their surface of contact with a document is in a horizontal plane. This recovers the horizontal disposition during extraction of documents in order for the support surface for documents extracted from the stack to be horizontal before they reach the downstream processing unit. Thus only the document feeder in the machine is modified and not the downstream units.

According to one feature, the second series of drive members is disposed downstream of the first series of drive members.

According to one feature, the horizontal plane and the inclined plane of contact of the two series of drive members intersect along a longitudinal straight line, said straight line being substantially tangential to one of the outside peripheral edges of one or more drive members of the first series which, given the inclination, are placed higher in a vertical direction, said one edge of the member or members being the higher of the two outside peripheral edges of said member or members.

This spatial arrangement of the document contact planes facilitates, during the extraction of a document, passage of the document from an inclined plane to a horizontal plane by causing it to pivot relative to the straight line of intersection of the planes.

During its extraction, the document is therefore displaced longitudinally by the extractor means at the same time as pivoting vertically relative to this straight line. According to one feature, the document extraction and transfer unit includes at least one document separator member.

That member encourages separation of documents during their extraction and serves as an abutment to prevent extraction of more than one document.

According to one feature, said at least one separator member is a longitudinal rib.

According to one feature, said at least one separation member is disposed outside the area covered by the second series of drive members. Arranged in this way, the separator member does not impede the operation of the drive members.

This arrangement of the upper surface of the feeder produces a soft transition for the documents on passing from an inclined support surface to a horizontal support surface. This facilitates the extraction operation.

DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

Other features and advantages will become apparent in the course of the following description given by way of nonlimiting example only with reference to the appended drawings, in which.

DETAILED DESCRIPTION OF THE PRESENT INVENTION

In describing the present invention, illustrative embodiments are described with reference made to the drawings, wherein there is seen in the Figures.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

Figure 2:
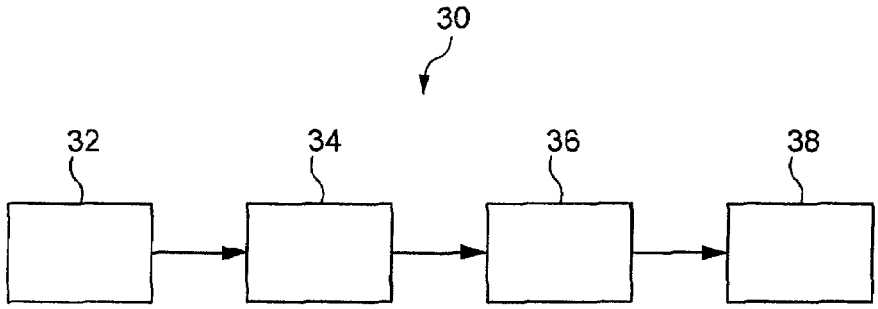
FIG. 2 is a general diagrammatic view of a one illustrative embodiment of a document processing machine of the invention.

As represented in FIG. 2 and designated by the general reference denoted 30, a document processing machine to which the invention applies comprises a document feeder station 32 which is adapted to receive a stack of documents, or even several stacks of documents. These documents can be envelopes, sheets of paper, labels.

The machine 30 also includes, downstream of this station, in the longitudinal document transfer direction, a station or unit for extracting documents from the stack supported by the feeder 32. This station 34 is also adapted to transfer documents extracted from the stack to a downstream processing unit or station 36.

When the documents stacked on the support of the feeder 32 are envelopes, the processing unit 36 is a moistening station, for example, at which the flaps of envelopes routed from the station 32 are wetted with a view to sealing them. Downstream of the station 36 is a document processing unit 38 which, when the documents are envelopes and have been sealed at the station 36, is, for example, an envelope franking station.

Figure 1A:
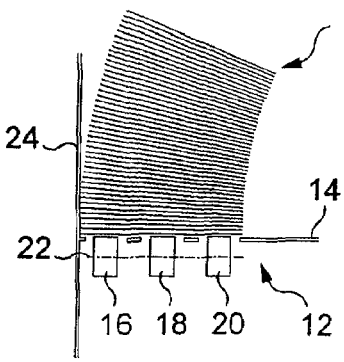
FIGS. 1*a*, 1*b* and 1*c* illustrate the problem of misalignment of a stack of documents.
Figure 1B:
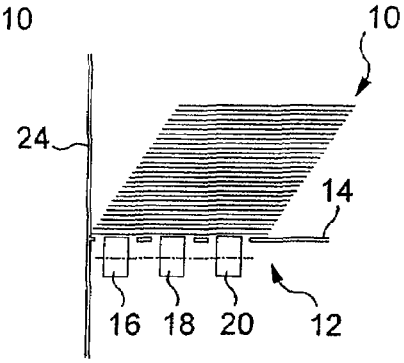
Figure 1C:
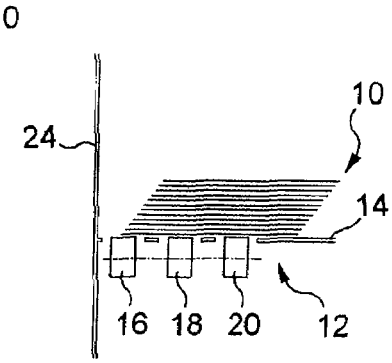
Figure 3:
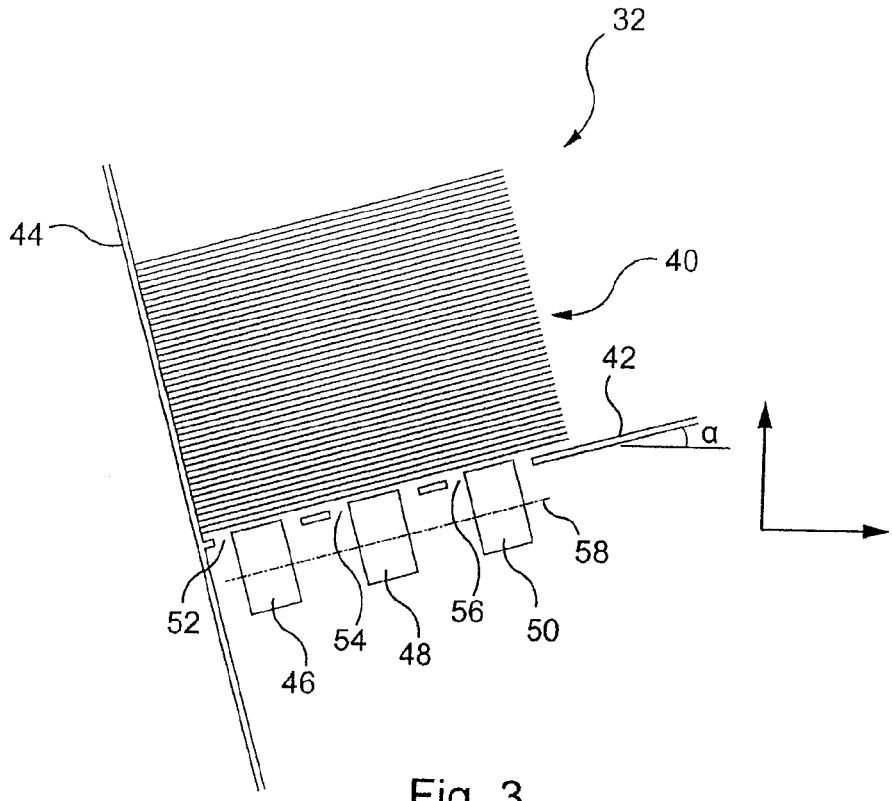
FIG. 3 is a diagrammatic general view analogous to that of FIGS. 1*a* to 1*c* of a document processing machine according to the illustrative embodiment of the invention.

FIG. 3 shows very diagrammatically, in a view analogous to the views of FIGS. 1*a* to 1*c*, the principle of inclining the document feeder of the machine 30 according to the illustrative embodiment of the invention.

It is therefore seen that the feeder 32 which supports a pile of documents or envelopes 40 is inclined relative to the horizontal transversely relative to the longitudinal document transfer direction, to prevent any offsetting of the stack upon extraction of documents situated at the bottom of the stack, as well as its possible inclination, if any, as illustrated with reference to FIGS. 1*a*, 1*b* and 1*c*.

More particularly, it is the portion of the feeder forming the support 42 of the stack 40 that is inclined at an angle α (FIG. 3) that is generally between 5 and 20°. As a general rule, the angle of inclination of the support 42 depends on the height of the stack of documents. Thus the higher the stack, the higher the value of the angle α. The angle α is preferably between 10 and 15° for most situations encountered in practice with such document processing machines. An inclination angle α equal to 10°, for example, gives good results for an envelope stack height of approximately 15 cm.

As shown in FIG. 3, the feeder 32 also includes a guide document 44. Moreover, under the support 42, there is a plurality of drive members 46, 48, 50 that project partially through respective openings 52, 54, 56 in the support 42 in order to be in contact with the document at the bottom of the stack 40. This arrangement of the drive members enables contact with the document via a contact surface and therefore extraction of the document from the stack. The members 46, 48, 50 are positioned transversely over a width (transverse dimension) that is sufficient to be adapted to the width of most documents.

The subsequent figures show in more detail the structure of the feeder and its operating mechanism. It will be noted in the light of FIG. 3, however, that the drive members 46, 48 and 50 are inclined relative to the horizontal with the same aforementioned inclination angle α and are mounted to rotate about an axis 58 that is also inclined at this angle α.

Figure 4:
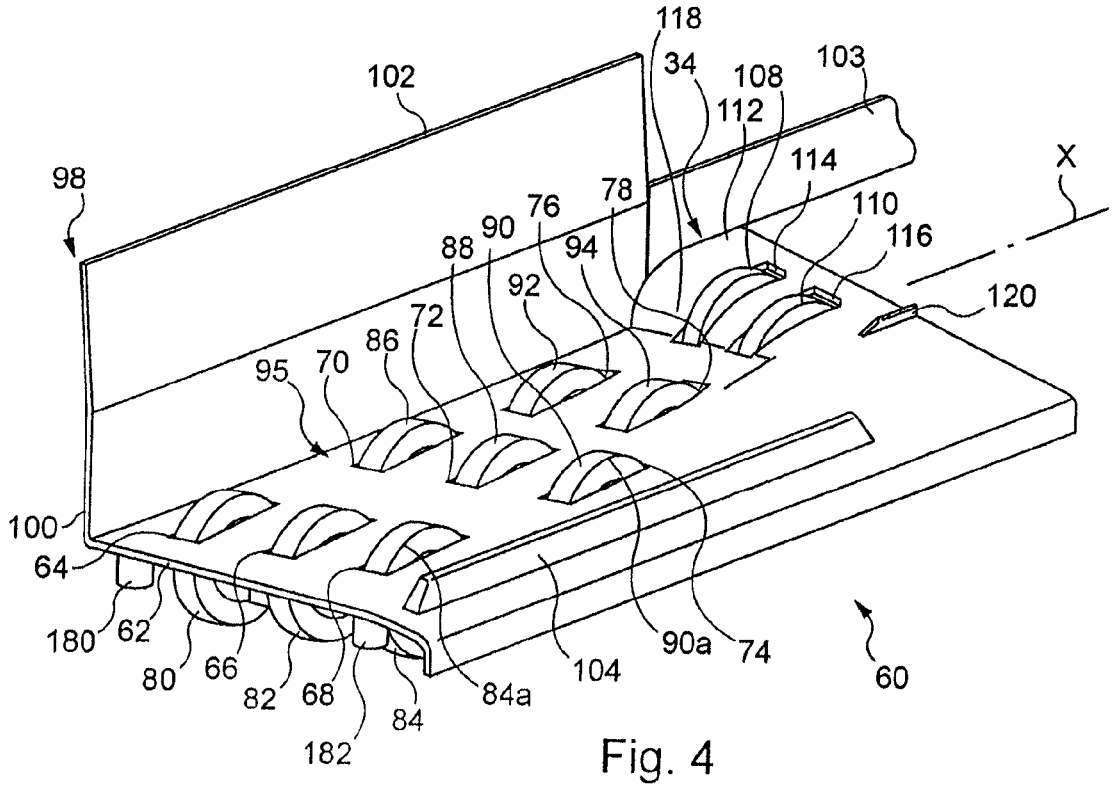
FIG. 4 is a diagrammatic perspective view of a document feeder of the machine represented in FIG. 3.

As represented in FIG. 4 by the general reference 60, a document feeder comprises a support 62 taking the form of a plate inclined relative to the horizontal at the angle α shown in FIG. 3, for example. This support is intended to receive a stack of documents not represented in FIG. 4.

The plate 62 is perforated by a plurality of openings or apertures 64, 66, 68, 70, 72, 74, 76 and 78 each having a substantially rectangular general shape and which are aligned in the longitudinal direction X of advance of documents in the machine 30.

Figure 5:
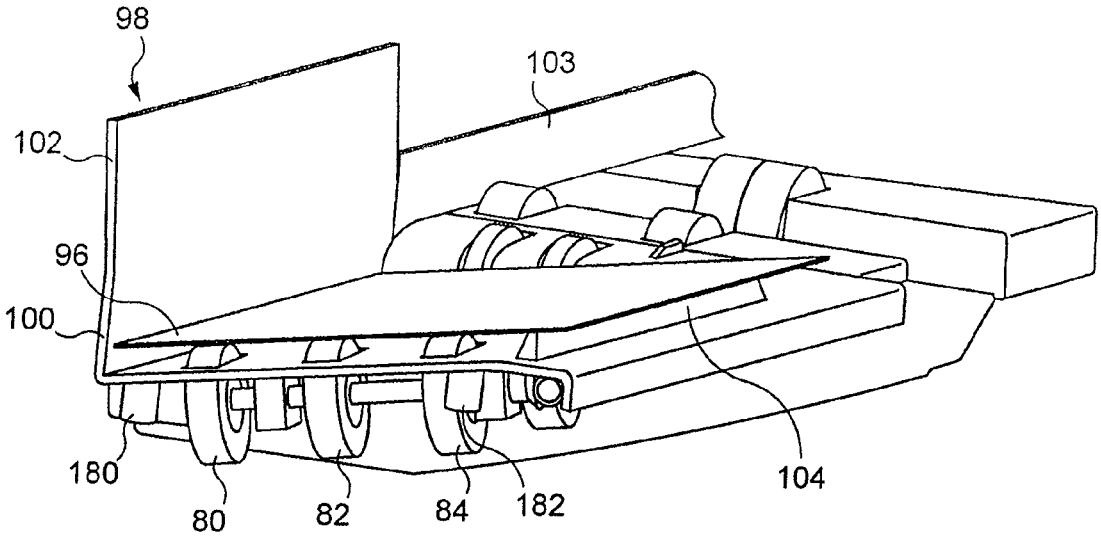
FIG. 5 is a perspective view of the FIG. 4 feeder with a document.

The feeder 60 also includes a plurality of drive members, for example taking the form of drive rollers 80, 82, 84, 86, 88, 90, 92, 94 each of which is partially inserted into one of the apertures (FIG. 4). These members therefore project relative to the upper surface of the plate 62 so as to come into contact with a document placed on top of them as shown in FIG. 5. These members form a first series 95 of support drive members. These members are disposed with an inclination relative to the horizontal, at the same inclination as the plate, so that the surface of contact of said members with a document 96 (FIG. 5) is disposed in a plane inclined relative to the horizontal.

As already explained with reference to FIG. 3, the drive members are each adapted to be driven in rotation about an axle (analogous to the axle 58 in FIG. 3) that is inclined relative to the horizontal at the angle α. The rotation axis of the members is directed in the downstream direction (FIG. 7) in such a manner as to form an angle less than 90° with the longitudinal document transfer direction X.

This inclination of the rotation axes of the members of the first series 95 encourages movement of the documents toward the wall 98 to be described hereinafter. As represented in FIG. 4, the first series 95 of drive members includes a number of rows (for example three rows in FIG. 4) of drive members that are disposed parallel to each other.

This arrangement has the advantage of facilitating driving of these members since they can then be mounted on a single drive axle per row. However, a different arrangement of the drive members can be envisaged to satisfy a criterion other than that of the simplicity of implementation. It will be noted that three drive members per row are sufficient to drive most documents of given width.

Furthermore, the arrangement of the drive members over the quasi-totality of the table 62 enables most documents with different dimensions to be supported. It will be noted that the arrangement and number of support and drive members can be different from those represented in the figures if the new members are of sufficient number and positioned appropriately to accommodate documents with varied dimensions.

The document feeder 60 also comprises a guide wall 98 that is disposed along the support of the feeder in the longitudinal document transfer direction X. This wall comprises two parts, a lower part 100 in contact with the support 62 on which the documents rest via the drive members passing partially through this support and a second part 102 that extends from the first part in the direction away from the support 62.

More particularly, the longitudinal lower part 100 of the guide 98 constitutes the active part of the guide since it guides documents situated in the lower part of the stack when they are driven by the drive members 80 to 94 in the document feeding direction X. Moreover, the upper part 102 of the guide 108 constitutes an inactive part since it merely retains the stack of inclined documents laterally. It will be noted that the lower part 100 and the upper part 102 of the guide wall 98 do not have the same inclination as each other.

In fact, the wall 100 forms with the support 62 a more acute angle than the upper part 102. The active lower part 100 is substantially aligned with the downstream guide wall 103 that begins at the extraction unit 34 and extends in the downstream direction.

This alignment of the two longitudinal guides means that documents are guided in the downstream direction without encountering any obstacle. On the other hand, the upper part 102 is at a more obtuse angle to the support than the lower part 100 since it serves mainly to hold the stack together.

It further serves to encourage alignment of the documents of the stack, which helps to increase the effectiveness of unstacking. For example, the lower part 100 of the guide wall 98 forms with the plate 62 an angle of inclination less than 90°, for example equal to 80° for an angle $\alpha$ equal to 10°. Thus the lower part 100 is substantially vertical, just like the downstream guide wall 103. A slight difference of inclination is nevertheless possible without impeding movement of the document. The angle formed between the parts 100 and 102 is 5°, for example. It can nevertheless be greater than this value (10°, 15°, . . . ), the upper limit of the angle being fixed by correct holding of the stack in position.

The document feeder also includes a supplementary support member 104 the function whereof is to contribute to supporting documents with greater dimensions than the documents that are usually supported sufficiently by the first series 95 of drive members. This element 104 extends transversely the area for supporting documents already supported by the drive members and is disposed outside the area in which those members are located. It will be noted in this regard that the height of the element 104 is substantially equal to the part of the drive members passing through the apertures in the support 62 in order for the contact surfaces of the document 96 and the supporting members of the feeder to be in the same inclined plane.

The supplementary support element is disposed along the support on the side opposite the guide wall 98 and is also substantially aligned in the longitudinal direction X. For example, the element 104 takes the form of a longitudinal rib the cross section whereof is substantially triangular, the base of the triangle being in contact with the upper surface of the plate 62. It will be noted, however, that instead of providing a single supplementary support member there may be envisaged a plurality of support members arranged in the same area as the element 104 in FIG. 4.

A number of supporting members can be substantially aligned in the direction X or arranged in the manner of a quincunx to cover the area. The support member(s) can alternatively be oriented toward the guide wall 98 to help to move documents toward it.

As represented in FIG. 4, the machine includes downstream of the feeder 60, in the direction of transfer of the documents in the direction X, a unit 34 whose primary function is to extract documents from the stack of documents resting on the feeder 60.

To this end, the unit 34 includes a series of drive members 106, referred to as the second series of drive members, disposed downstream of the first series. The drive members of the second series 106 are disposed in such a manner that their contact surface with a document is in a horizontal plane, in order to make good the angular offset caused by the inclination of the support 62 with a view to transferring extracted documents onto a horizontal support. Documents extracted from the stack are then transferred to the horizontal support of the downstream processing unit 36, for example.

Thus the machine according to the invention solves the misalignment problem by laterally inclining the document support whilst retaining a horizontal document exit. It will be noted that the second series of drive members 106 includes, in the example shown, two members 108 and 110 that take the form of rollers, for example, which are adapted to be driven in rotation about a transverse horizontal axis perpendicular to the longitudinal direction X (this axis can be seen in FIG. 7).

The extraction unit 34 comprises a horizontal support 112 in which are formed two apertures 114, 116 through which project the two drive members 108, 110, respectively. This unit aligned with the inclined support 62 is connected to the latter by a connecting area 118, thereby providing a continuous or discontinuous transition between the inclined surface of the support 62 and the horizontal surface of the unit 34.

In a variant that is not shown the support 62 can be independent of the unit 34 and means can be provided for adjusting the inclination of the support, for example as a function of the height of the stack. The unit 34 also includes a member 120 helping to separate documents that takes the form of a longitudinal rib (FIG. 4), for example, with a height substantially equal to the height of the projecting portion of the drive members 108 and 110. This member is disposed outside the area covered by the members 108 and 110 and serves to separate documents extracted from the stack. It will be noted that a number of members similar to the member 120 can be provided on the surface 112, being disposed parallel to each other, for example.

Figure 6:
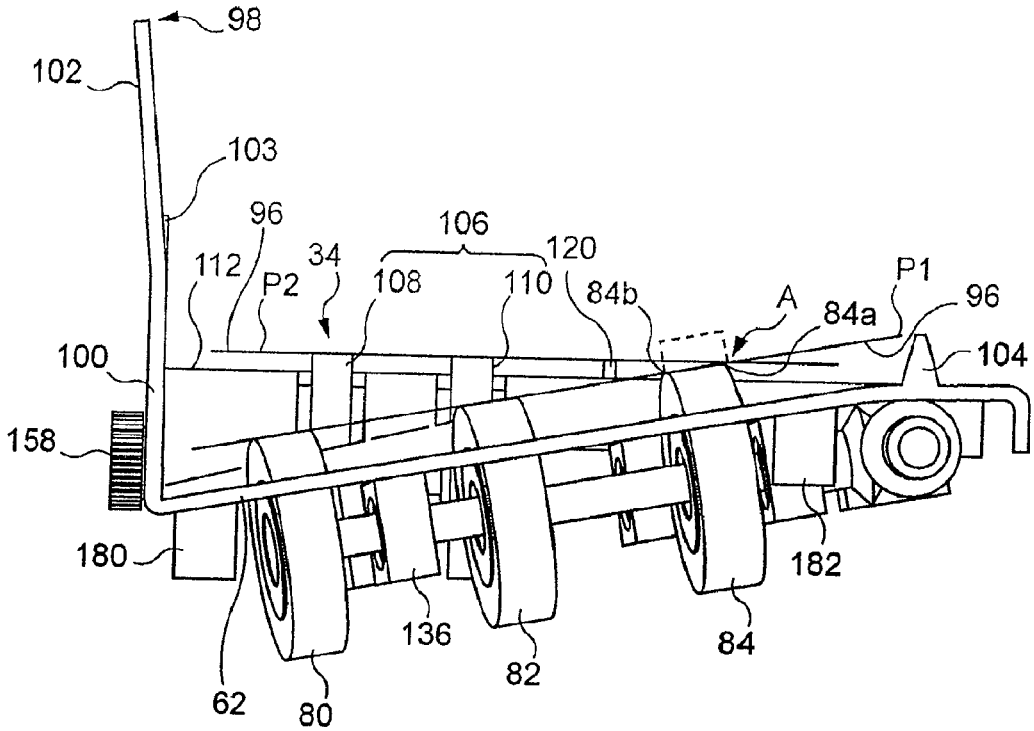
FIG. 6 is an end view similar to that of FIG. 3 showing the document feeder and separator in more detail.

FIG. 6 is a view in cross section of the document processing machine according to the invention as seen from the document feeder end. There are shown in this figure the inclined plane P1 of contact between a document 96 and the first series 95 of drive members and the horizontal plane P2 of contact between that same document 96 (after its extraction) and the second series of drive members 106.

These two planes intersect in space along a straight line which, when projected into the plane of FIG. 6, is reduced to a point A. This straight line is tangential to one of the two outside edges of the drive member of the first series that is the highest relative to the other drive members of that same series, given their inclination.

In FIG. 6, the highest member is the member 84, which has two outside edges 84*a* and 84*b*. Given the inclination of the member 84, the outside edge 84*a* is higher than the outside edge 84*b*. Consequently, the straight line of intersection of the planes P1 and P2 is tangential to the edge 84*a* of the member 84, likewise the outside edge 90*a* of the member 90 in FIG. 4 because it is aligned with the member 84.

Given this arrangement, when the drive members of the first series are driven in rotation, the document placed in the plane P1 is driven to move in the longitudinal transfer direction X toward the members of the second series 106. The document pivots in space around the straight line materialized by the point A in FIG. 6 as it is extracted by the drive members 108 and 110.

This pivoting at the same time as moving in translation thus enables a document to pass from an inclined support to a horizontal support, namely that of extraction unit 34. It will be noted that the guide 120 helps to separate the documents. It should be noted that if the two planes P1 and P2 do not intercept along the straight line tangential to the outside edge of the highest member, extraction of documents is less effective.

With the arrangement shown in FIG. 6, the pivoting point of the document is positioned close to one edge of the document rather than at its center, which facilitates its pivoting. In particular, if the drive member that is highest relative to the drive members of the first series were to be extended as indicated in dashed line in FIG. 6, then the two planes P1 and P2 would intersect along a straight line situated closer to the center of the feeder, i.e. toward the drive members of the series 106. This arrangement would then make extraction and pivoting of the document in the same area particularly difficult.

It is in fact preferable for the pivoting point of the document to be far away from the area in which the extraction members are disposed.

Figure 7:
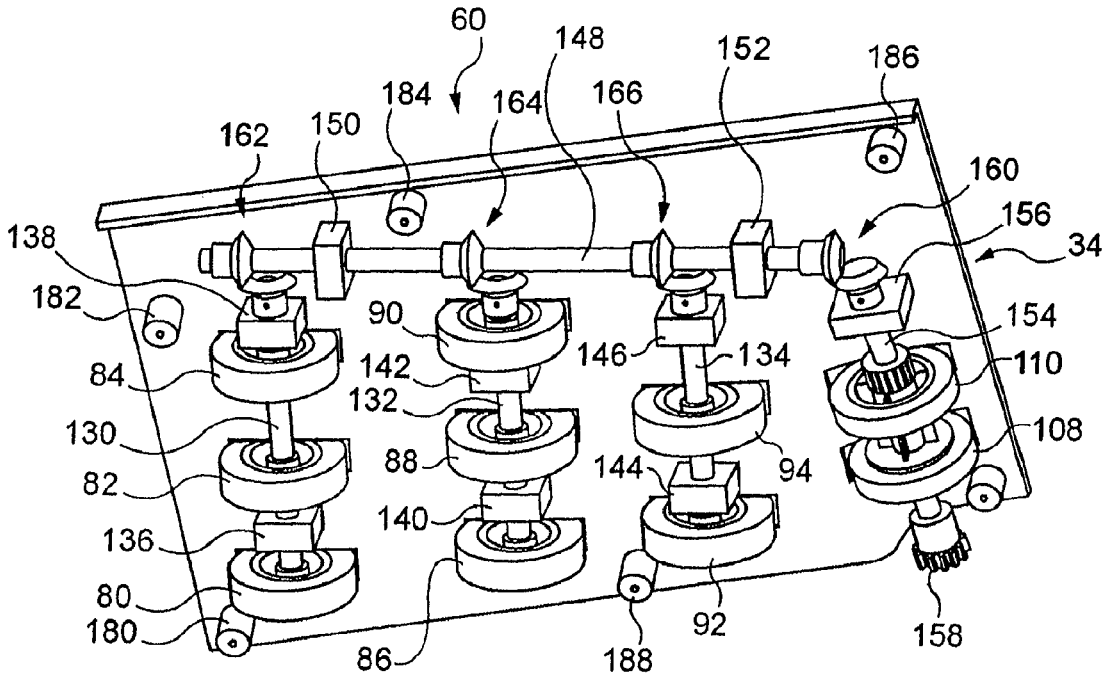
FIG. 7 is a perspective view from below of the document feeder represented in FIGS. 3 to 6.

FIG. 7 represents a perspective view from below of the feeder 60 and the extraction unit 34. It shows the mounting of the drive members 80 to 94 of the first series 95 on axles 130, 132, 134 arranged parallel to each other and oriented obliquely relative to the longitudinal direction X. In particular, the members 80, 82 and 84 are mounted to rotate on the axle 130, the members 86, 88 and 90 are mounted to rotate on the axle 132, and the members 92 and 94 are mounted to rotate on the axle 134.

Rolling bearings fixed to the lower surface of the support 62 support these axles. More particularly, bearings 136 and 138 are mounted on the axle 130, bearings 140 and 142 are mounted on the axle 132, and bearings 144 and 146 are mounted on the axle 134. Each of these axles is concurrent with the axle 148, on which bearings 150 and 152 are also mounted. Another rotation axle 154 is arranged under the extraction unit 34 and the drive members 108 and 110 are mounted to rotate on it. A bearing 156 is provided for this axle 154, which is also concurrent with the aforementioned axle 148.

It will be noted that the axles of the first series 95 of drive members and the axle of the second series 106 of drive members are not disposed parallel to each other. This gives preference to the orientation of the displacement of the documents perpendicularly to the axles of the first series 95 in the plane of the inclined support.

A take-up gear 158 is mounted on the drive axle 154 and is driven in rotation via a chain or a belt (not shown) that is connected to a drive unit such as a motor. Rotation of the motor transmits rotation, via an appropriate mechanism, to the take-up gear 158, thus driving rotation of the axle 154 and the members mounted on it. Thanks to a system of meshing bevel gears 160, the rotation of the axle 154 is transmitted to the axle 148 which distributes the rotation to each of the axles 130, 132 and 134 via another system of meshing bevel gears 162, 164 and 166.

Figure 8:
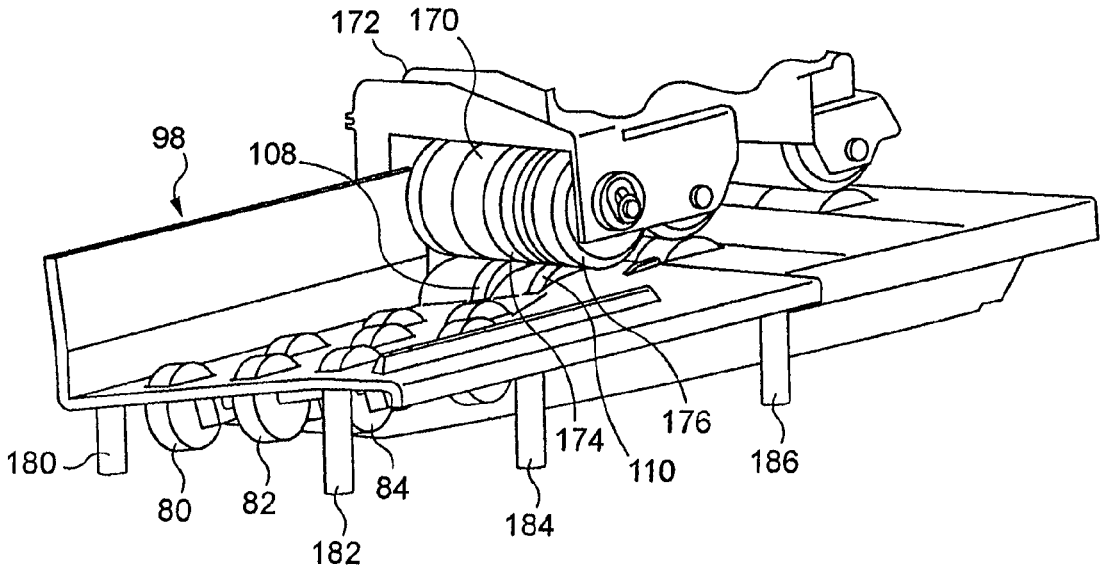
FIG. 8 is a general diagrammatic view in perspective analogous to that of FIG. 4 and completed by the presence of an upper separator drum.

The arrangements of meshing bevel gears provide a homokinetic drive with axles having different inclinations (here three different inclinations). There is shown in FIG. 8 the upper part of the extraction unit 34, which takes the form of a separator drum 170 mounted to rotate about a transverse horizontal axle and supported by an upper frame 172 fixed to the framework of the machine.

The drum 170 is disposed above the drive members 108 and 110 and includes two rubber rings 174 and 176 offset transversely relative to the members 108 and 110.

These rings are mounted on an axle that turns in the same direction as the axle 154 but at a lower speed. Thus the document entering between the members 108, 110 and the rings 174, 176 is slowed by the latter which serve as abutments, so to speak.

The guide 120 serves to support the document and therefore to hold it in contact with the ring 176. Moreover, the feeder 60 comprises a plurality of feet 180, 182, 184, 186, 188, all of which can be seen in FIG. 7, by means of which the document feeder and the document extraction unit rest on a base or a plinth in a stable manner.

It will be noted that the height of the feet represented in the figures other than FIG. 8 has been truncated for reasons of visibility. Thanks to the invention, the problems of misalignment of a stack of documents placed on the feeder table described with reference to FIGS. 1*a* to 1*c* are avoided with minimum modifications to the document processing machine.

It would in fact have been possible to envisage inclining all the processing stations or units of the machine, but the modifications would have been more extensive and therefore more costly. Thanks to the invention, manual intervention by operators necessitated by problems of misalignment of the stack of documents are virtually eliminated.

What is claimed is:

1. A document processing machine comprising:

a document feeder including a support intended to receive a stack of documents, and a unit for extracting documents from the stack of documents and transferring the extracted documents onto a horizontal support of a downstream processing unit, wherein, the support of the document feeder is inclined relative to the horizontal, and wherein the support of the document feeder comprises a first series of drive and support members arranged in such a manner that the contact surface of the members with a document is in a plane inclined relative to the horizontal.

2. The machine according to claim 1, wherein the support is inclined at an angle between 5 and 20° and preferably between 10 and 15°.

3. The machine according to claim 1, wherein the feeder includes a document guide disposed along the feeder support in the longitudinal direction of transfer of documents, the guide forming with the horizontal, in cross section, an angle substantially corresponding to the angle to the horizontal of a downstream document guide disposed in part at the extraction and transfer unit.

4. The machine according to claim 3, wherein the guide constitutes the lower part of a wall and is adjacent to the inclined support.

5. The machine according to claim 4, wherein the wall includes an upper part that is inclined outward relative to the lower part.

6. The machine according to claim 3, wherein the guide and the downstream guide are substantially coplanar.

7. The machine according to claim 1, wherein the support of the document feeder comprises at least one supplementary support member for supporting documents.

8. The machine according to claim 7, wherein said at least one supplementary supporting member is disposed along the support in the longitudinal document transfer direction, on the side opposite the document guide.

9. The machine according to claim 1, wherein the drive members of the first series are adapted to be driven in rotation about an axis inclined relative to the horizontal, directed in the downstream direction and forming an angle less than 90° with the longitudinal document transfer direction.

10. The machine according to claim 1, wherein the first series of drive members includes a number of rows of members mounted to rotate about parallel axes.

11. The machine according to claim 7, wherein said at least one supplementary support member of the support of the document feeder is disposed outside the area in which the first series of drive members is installed in order to support documents having, in cross section, dimensions greater than those of the area covered by the first series of drive members.

12. The machine according to claim 7, wherein said at least one supplementary supporting element is a longitudinal rib.

13. The machine according to claim 1, wherein the support of the document feeder comprises a plate inclined relative to the horizontal, perforated by apertures through which the drive members of the support project relative to an upper surface of the plate.

14. The machine according to claim 13, wherein said at least one supplementary support member is disposed on the upper surface of the plate.

15. The machine according to claim 1, wherein the unit for extracting and transferring documents includes a second series of drive members adapted to be driven in rotation about a transverse axis perpendicular to the longitudinal document transfer direction, the drive members being arranged in such a manner that their surface of contact with a document is in a horizontal plane.

16. The machine according to claims 1, wherein the second series of drive members is disposed downstream of the first series of drive members.

17. The machine according to claim 1, wherein the horizontal plane and the inclined plane of contact of the two series of drive members intersect along a longitudinal straight line, said straight line being substantially tangential to one of the outside peripheral edges of one or more drive members of the first series which, given the inclination, are placed higher in a vertical direction, said one edge of the member or members being the higher of the two outside peripheral edges of said member or members.

18. The machine according to claim 1, wherein the unit for extracting and transferring documents includes at least one document separator member.

19. The machine according to claim 18, wherein said at least one separator member is a longitudinal rib.

* * * * *